US011032663B2

(12) United States Patent
Choueiri et al.

(10) Patent No.: US 11,032,663 B2
(45) Date of Patent: Jun. 8, 2021

(54) SYSTEM AND METHOD FOR VIRTUAL NAVIGATION OF SOUND FIELDS THROUGH INTERPOLATION OF SIGNALS FROM AN ARRAY OF MICROPHONE ASSEMBLIES

(71) Applicant: The Trustees of Princeton University, Princeton, NJ (US)

(72) Inventors: Edgar Y. Choueiri, Princeton, NJ (US); Joseph Tylka, Princeton, NJ (US)

(73) Assignee: The Trustees of Princeton University, Princeton, NJ (US)

( * ) Notice: Subject to any disclaimer, the term of this patent is extended or adjusted under 35 U.S.C. 154(b) by 0 days.

(21) Appl. No.: 16/338,078

(22) PCT Filed: Sep. 29, 2017

(86) PCT No.: PCT/US2017/054404

§ 371 (c)(1),
(2) Date: Mar. 29, 2019

(87) PCT Pub. No.: WO2018/064528

PCT Pub. Date: Apr. 5, 2018

(65) Prior Publication Data

US 2020/0021940 A1 Jan. 16, 2020

Related U.S. Application Data

(60) Provisional application No. 62/401,463, filed on Sep. 29, 2016.

(51) Int. Cl.
*H04R 5/00* (2006.01)
*H04S 5/02* (2006.01)
(Continued)

(52) U.S. Cl.
CPC ..... *H04S 7/304* (2013.01); *H04R 1/406* (2013.01); *H04R 3/005* (2013.01); *H04R 5/02* (2013.01);
(Continued)

(58) Field of Classification Search
CPC ..... H04R 1/406; H04R 3/005; H04R 5/02; H04R 5/027; H04S 2400/03; H04S 2400/15; H04S 2420/11; H04S 7/303
(Continued)

(56) References Cited

U.S. PATENT DOCUMENTS

2006/0045275 A1 3/2006 Daniel
2013/0216070 A1 8/2013 Keiler et al.
(Continued)

OTHER PUBLICATIONS

Berge et al., "A New Method for B-Format to Binaural Transcoding," presented at the 40th International Conference of the Audio Engineering Society, Tokyo, Japan, Oct. 8-10, 2010, 10 pages.
(Continued)

*Primary Examiner* — George C Monikang
(74) *Attorney, Agent, or Firm* — Wilmer Cutler Pickering Hale and Dorr LLP

(57) ABSTRACT

The system and method for virtual navigation of a sound field through interpolation of the signals from an array of microphone assemblies utilizes an array of two or more higher-order Ambisonics (HOA) microphone assemblies, which measure spherical harmonic coefficients (SHCs) of the sound field from spatially-distinct vantage points, to estimate the SHCs at an intermediate listening position. First, sound sources near to the microphone assemblies are detected and located. Simultaneously, the desired listening position is received. Only the microphone assemblies that are nearer to said desired listening position than to any near sources are considered valid for interpolation. The SHCs from these valid microphone assemblies are then interpo-
(Continued)

lated using a combination of weighted averaging and linear translation filters. The result is an estimate of the SHCs that would have been captured by a HOA microphone assembly placed in the original sound field at the desired listening position.

12 Claims, 6 Drawing Sheets

(51) Int. Cl.

| | |
|---|---|
| ***H04S 7/00*** | (2006.01) |
| ***H04R 1/40*** | (2006.01) |
| ***H04R 3/00*** | (2006.01) |
| ***H04R 5/02*** | (2006.01) |
| ***H04R 5/027*** | (2006.01) |
| ***H04R 5/033*** | (2006.01) |
| ***H04S 3/00*** | (2006.01) |

(52) U.S. Cl.
CPC ..... *H04R 5/027* (2013.01); *H04R 5/033* (2013.01); *H04S 3/008* (2013.01); *H04S 2400/01* (2013.01); *H04S 2400/15* (2013.01); *H04S 2420/11* (2013.01)

(58) Field of Classification Search
USPC ..... 381/17–19, 22, 23
See application file for complete search history.

(56) References Cited

U.S. PATENT DOCUMENTS

2014/0355766 A1 12/2014 Morrell et al.
2014/0355771 A1 12/2014 Peters et al.
2014/0358565 A1 12/2014 Peters et al.

OTHER PUBLICATIONS

Farina et al., "Spatial Sound Recording with Dense Microphone Arrays," presented at the 55th AES International Conference, Helsinki, Finland, Aug. 27-29, 2014, 8 pages.
Gumerov et al. "Chapter 3. Translations and Rotations of Elementary Solutions," Fast Multipole Methods for the Helmholtz Equation in Three Dimensions, published by Elsevier Science, Jan. 27, 2005, pp. 89-137.
Heller et al., "A Toolkit for the Design of Ambisonic Decoders," Presented at the Linux Audio Conference, Stanford University, California, Apr. 12-15, 2012, 12 pages.
International Search Report and Written Opinion dated Dec. 5, 2017, in the International Application No. PCT/US17/54404, 23 pages.
Meyer et al., "A highly scalable spherical microphone array based on an orthonormal decomposition of the soundfield," 2002 IEEE International Conference on Acoustics, Speech, and Signal Processing, Orlando, FL, May 13-17, 2002, pp. 1781-1784.
Poletti, "Three-Dimensional Surround Sound Systems Based on Spherical Harmonics," Journal of the Audio Engineering Society, Nov. 2005, vol. 53, No. 11, pp. 1004-1025.
Schultz et al., "Data-based Binaural Synthesis Including Rotational and Translatory Head-Movements," presented at the 52nd International Conference of the Audio Engineering Society, Guildford, UK, Sep. 2-4, 2013, 11 pages.
Southern et al., "Rendering walk-through auralisations using wave-based acoustical models," presented at the 17th European Signal Processing Conference (EUSIPCO 2009), Glasgow, UK, Aug. 24-28, 2009, pp. 715-719.
Tylka et al., "Comparison of Techniques for Binaural Navigation of Higher-Order Ambisonic Soundfields," Audio Engineering Society, Convention Paper 9421, Presented at the 139th Convention, Oct. 29 to Nov. 1, 2015, 13 pages.
Tylka et al., "Soundfield Navigation using an Array of Higher-Order Ambisonics Microphones," Presented at the Conference on Audio for Virtual and Augmented Reality, Los Angeles, CA, Sep. 30 to Oct. 1, 2016, 10 pages.
Xie "Chapter 9. Binaural Reproduction through Loudspeakers," Head-Related Transfer Function and Virtual Auditory Display, published by J. Ross Publishing, Jun. 2013, pp. 283-326.
Zheng, "Soundfield navigation: Separation, compression and transmission," Doctor of Philosophy Thesis, School of Electrical, Computer, and Telecommunications Engineering, University of Wollongong, 254 pages (2013).
Zotkin et al., "Plane-Wave Decomposition of Acoustical Scenes Via Spherical and Cylindrical Microphone Arrays," IEEE Transactions on Audio, Speech, and Language Processing, Jan. 2010, vol. 18, Issue 1, 29 pages.

SYSTEM AND METHOD FOR VIRTUAL NAVIGATION OF SOUND FIELDS THROUGH INTERPOLATION OF SIGNALS FROM AN ARRAY OF MICROPHONE ASSEMBLIES

This application is a national stage application of prior International Application No. PCT/US2017/54404, entitled "System and Method for Virtual Navigation of Sound Fields through Interpolation of Signals from an Array of Microphone Assemblies," filed Sep. 29, 2017 which relates and claims priority under 35 U.S.C. § 119(e) to U.S. Provisional Patent Application No. 62/401,463, titled "System and Method for Virtual Navigation of Sound Fields through Interpolation of Signals from an Array of Microphone Assemblies," which was filed on Sep. 29, 2016 each of which are hereby incorporated by reference herein in their entirety.

BACKGROUND

This application is directed to a system and method for virtual 2D or 3D navigation of a recorded (or synthetic) or live sound field through interpolation of the signals from an array of two or more microphone systems (each comprising an assembly of multiple microphone capsules) to estimate the sound field at an intermediate position.

Sound field recordings are commonly made using spherical or tetrahedral assemblies of microphones, which capture spherical harmonic coefficients (SHCs) of the sound field, thereby providing a mathematical representation of the sound field. The SHCs, also called higher-order Ambisonics (HOA) signals, can then be rendered for playback over headphones (or earphones), two-channel stereo loudspeakers, or one of many other multi-channel loudspeaker configurations. Ideally, playback results in a perceptually realistic reproduction of the 3D sound field from the vantage point of the microphone assembly.

From a single microphone assembly, the SHCs accurately describe the recorded sound field only in a finite region around the location of the assembly, where the size of said region increases with the number of SHCs but decreases with increasing frequency. Furthermore, the SHCs are only a valid description of the sound field in the free field, i.e., in a spherical region around the microphone assembly that extends up to the nearest source or obstacle. A review of this theory is given by M. A. Poletti in the article "Three-Dimensional Surround Sound Systems Based on Spherical Harmonics," published November, 2005, in volume 53, issue 11 of the Journal of the Audio Engineering Society.

An existing category of sound field navigation techniques entails identifying, locating, and isolating discrete sound sources, which may then be artificially moved relative to the listener to simulate navigation. The details of this method are given by Xiguang Zheng in the thesis "Soundfield navigation: Separation, compression and transmission," published in 2013 by the University of Wollongong. This type of technique is only applicable to sound fields consisting of a finite number of discrete sources that can be easily separated (i.e., sources that are far enough apart or not emitting sound simultaneously). Furthermore, even in ideal situations, the source separation technique employed in the time-frequency domain (i.e., short-time Fourier transform domain) often results in a degradation of sound quality.

An alternative technique is to average the SHCs directly, and is described by Alex Southern, Jeremy Wells, and Damian Murphy in the article "Rendering walk-through auralisations using wave-based acoustical models," presented at the 17$^{th}$ European Signal Processing Conference (EUSIPCO), 2009. However, if a sound source is nearer to one microphone assembly than to another, this technique will necessarily produce two copies of the source's signal, separated by a finite time delay, yielding a comb-filtering-like effect.

It is therefore an objective of the present invention to provide a system and method for generating virtual navigable sound fields in 2D or 3D without introducing spectral coloration or degrading sound quality.

SUMMARY

The system and method for virtual navigation of a sound field through interpolation of the signals from an array of microphone assemblies of the present invention utilizes an array of two or more higher-order Ambisonics (HOA) microphone assemblies, which measure spherical harmonic coefficients (SHCs) of the sound field from spatially-distinct vantage points, to estimate the SHCs at an intermediate listening position. First, sound sources near to the microphone assemblies are detected and located either acoustically using the measured SHCs or by simple distance measurements. Simultaneously, the desired listening position is received via an input device (e.g., a keyboard, mouse, joystick, or a real-time head/body tracking system). Only the microphone assemblies that are nearer to said desired listening position than to any near sources are considered valid for interpolation. The SHCs from these valid microphone assemblies are then interpolated using a combination of weighted averaging and linear translation filters. The result is an estimate of the SHCs that would have been captured by a HOA microphone assembly placed in the original sound field at the desired listening position.

DETAILED DESCRIPTION

In general, the system and method for virtual navigation of a sound field through interpolation of the signals from an array of microphone assemblies of the present invention involves an array of two or more compact microphone assemblies that are used to capture spherical harmonic coefficients (SHCs) of the sound field from spatially distinct vantage points. Said compact microphone assembly may be the tetrahedral SoundField DSF-1 microphone by TSL Products, the spherical Eigenmike by mh Acoustics, or any other microphone assembly consisting of at least four (4) microphone capsules arranged in a 3D configuration (such as a sphere). First, the microphone assemblies are arranged in the sound field at specified positions (or, alternatively, the positions of the microphone assemblies are determined by simple distance measurements), and any sound sources near to the microphone assemblies (i.e., near-field sources) are detected and located either by simple distance measurements, through triangulation using the signals from the microphone assemblies, or with any other existing source localization techniques found in the literature. Simultaneously, the desired listening position is either specified manually with an input device (such as a keyboard, mouse, or joystick) or measured by a real-time head/body tracking system. Next, the desired position of the listener, the locations of the microphone assemblies, and the previously determined locations of any near-field sources are used to determine the set of microphone assemblies for which the listening position is valid. Based on the positions of each of the valid microphone assemblies and the listening position, a set of interpolation weights is computed. Ultimately, the SHCs from the valid assemblies are interpolated using a combination of weighted averaging and linear translation filters. Such linear translation filters are described by Joseph G. Tylka and Edgar Y. Choueiri in the article "Comparison of Techniques for Binaural Navigation of Higher-Order Ambisonic Soundfields," presented at the 139$^{th}$ Convention of the Audio Engineering Society, 2015.

Figure 1:
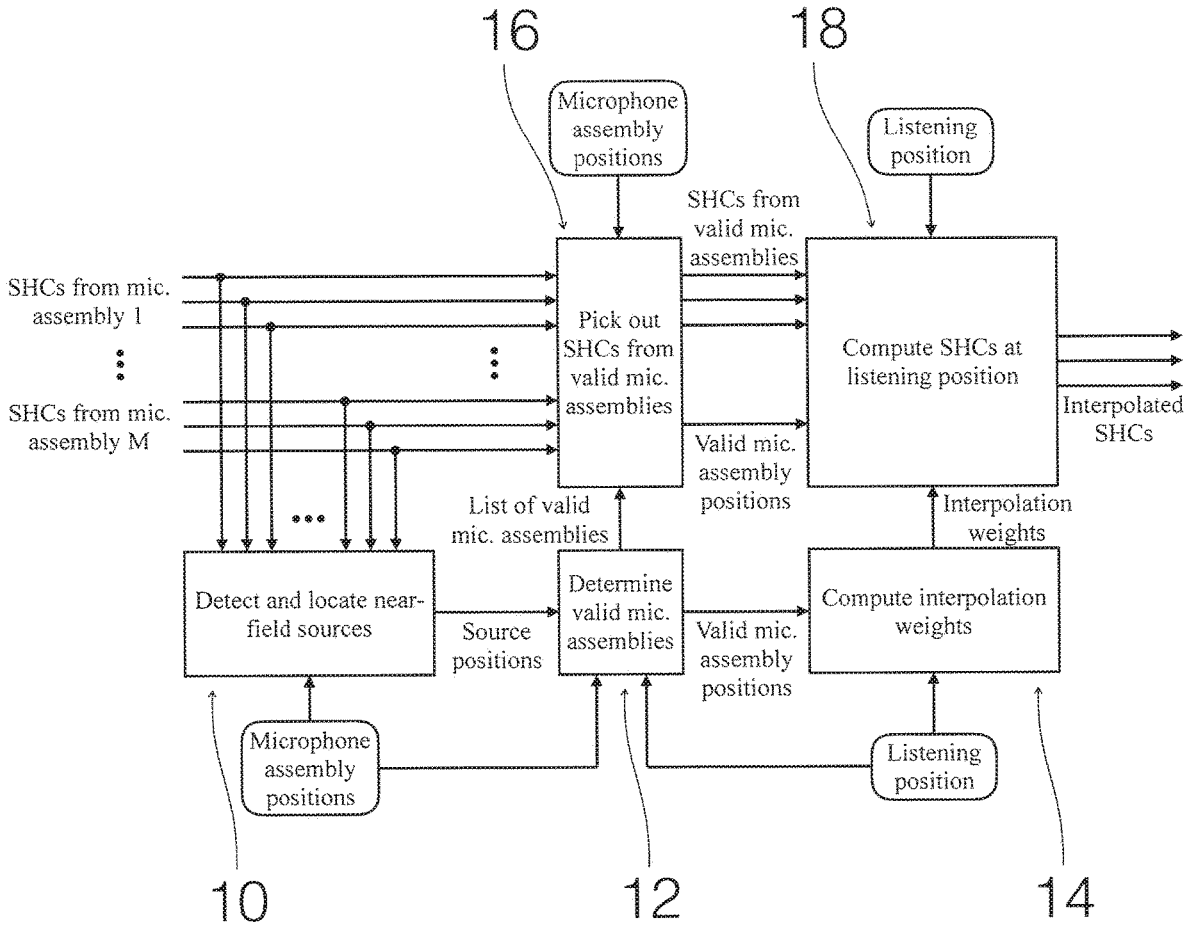
FIG. 1 is a flowchart of the general method for virtual navigation of a sound field through interpolation of the signals from an array of microphone assemblies of the present invention.

The general method for virtual navigation of a sound field through interpolation of the signals from an array of microphone assemblies of the present invention is depicted in FIG. 1. The method begins with the measured SHCs from two or more microphone assemblies. In step 10, the measured SHCs are used in conjunction with the known (or measured) positions of the microphone assemblies to detect and locate near-field sources. Methods for locating near-field sources using SHCs from one or more microphone assemblies are discussed by Xiguang Zheng in chapter 3 of the thesis "Soundfield navigation: Separation, compression and transmission," published in 2013 by the University of Wollongong. Rather than locating near-field sources in order to isolate the sound signals emitted from said near-field sources, the present method only requires determining the locations of any near-field sources. Alternatively, the positions of the near-field sources can be determined through simple distance measurements.

Figure 2:
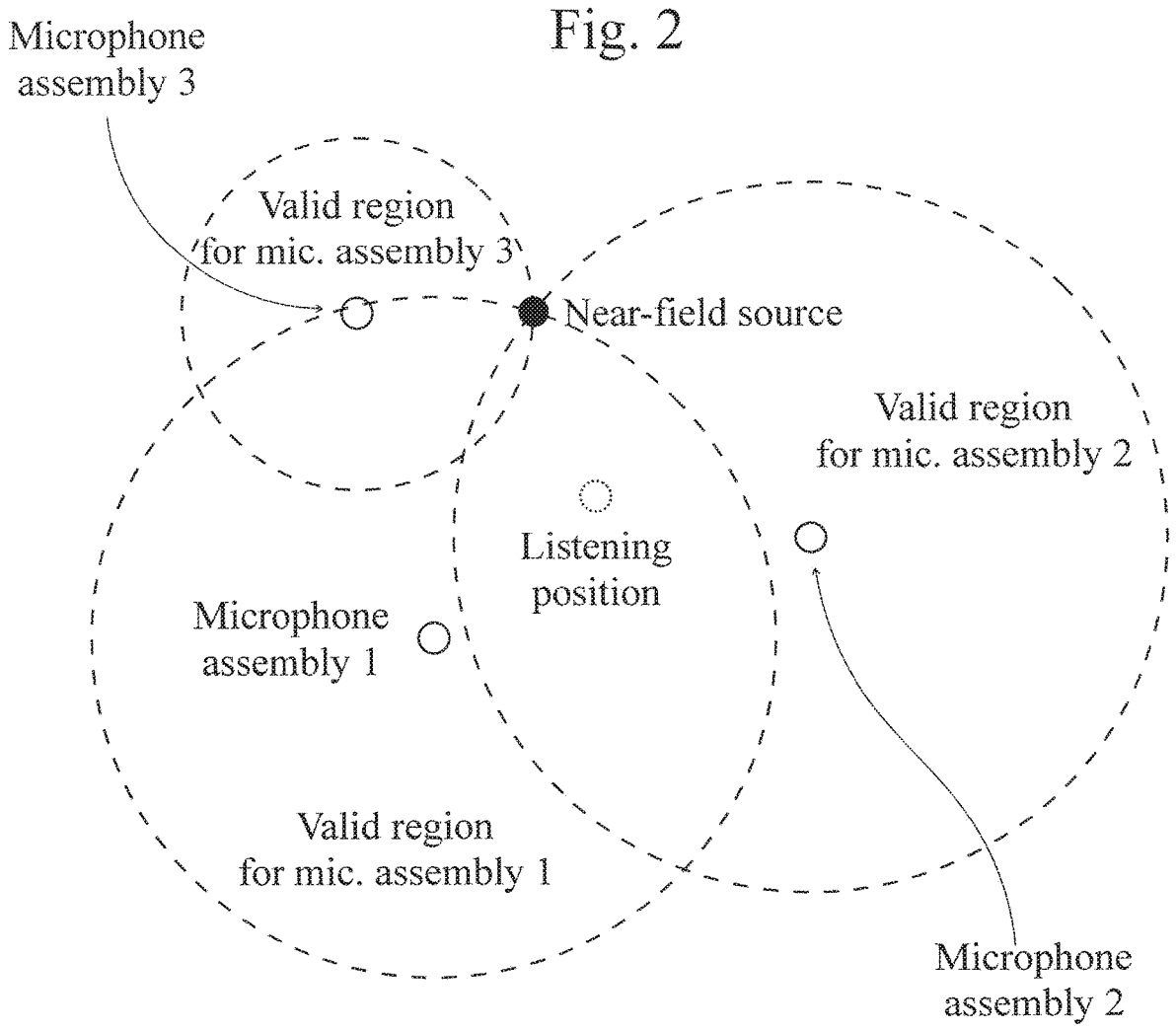
FIG. 2 is a diagram depicting regions of validity for several microphone assemblies based on the positions of the microphone assemblies, the listener, and of a near-field source.

In step 12, the desired position of the listener, the locations of the microphone assemblies, and the previously determined locations of any near-field sources are used to determine the set of microphone assemblies for which the listening position is valid. The spherical harmonic expansion describing the sound field from each microphone assembly is a valid description of said sound field only in a spherical region around the microphone assembly that extends up to the nearest source or obstacle. Consequently, if a microphone assembly is nearer to a near-field sound source than said microphone assembly is to the listening position, then the SHCs captured by that microphone assembly are not suitable for describing the sound field at the listening position. By comparing the distances from each microphone assembly to its nearest source and the distance of that microphone assembly to the listening position, a list of the valid microphone assemblies is compiled. As an example, the geometry of a typical situation is depicted in FIG. 2, in which only the SHCs measured by microphone assemblies 1 and 2 provide valid descriptions the sound field at the desired listening position, while the SHCs measured by microphone assembly 3 do not provide a valid description the sound field at the desired listening position.

In step 14, the positions of the valid microphone assemblies are used in conjunction with the desired listening position to compute a set of interpolation weights. Depending on the geometry of the valid microphone assemblies and the listening position, the weights may be calculated using standard interpolation methods, such as linear or bilinear interpolation weights. A simple implementation for an arbitrary geometry is to compute each weight based on the reciprocal of the respective microphone assembly's distance from the listening position. Generally, the interpolation weights should be normalized such that either the sum of the weights or the sum of the squared weights is equal to 1.

In step 16, the list of valid microphone assemblies is used to isolate (i.e., pick out) only the SHCs from said valid microphone assemblies. These SHCs from said valid microphone assemblies, as well as the previously computed interpolation weights, are then passed to the interpolation block for step 18. In general, the interpolation step 18 involves a combination of weighted averaging and linear translation filters applied to the valid SHCs. In the following discussion, three potential implementations are described.

Figure 3:
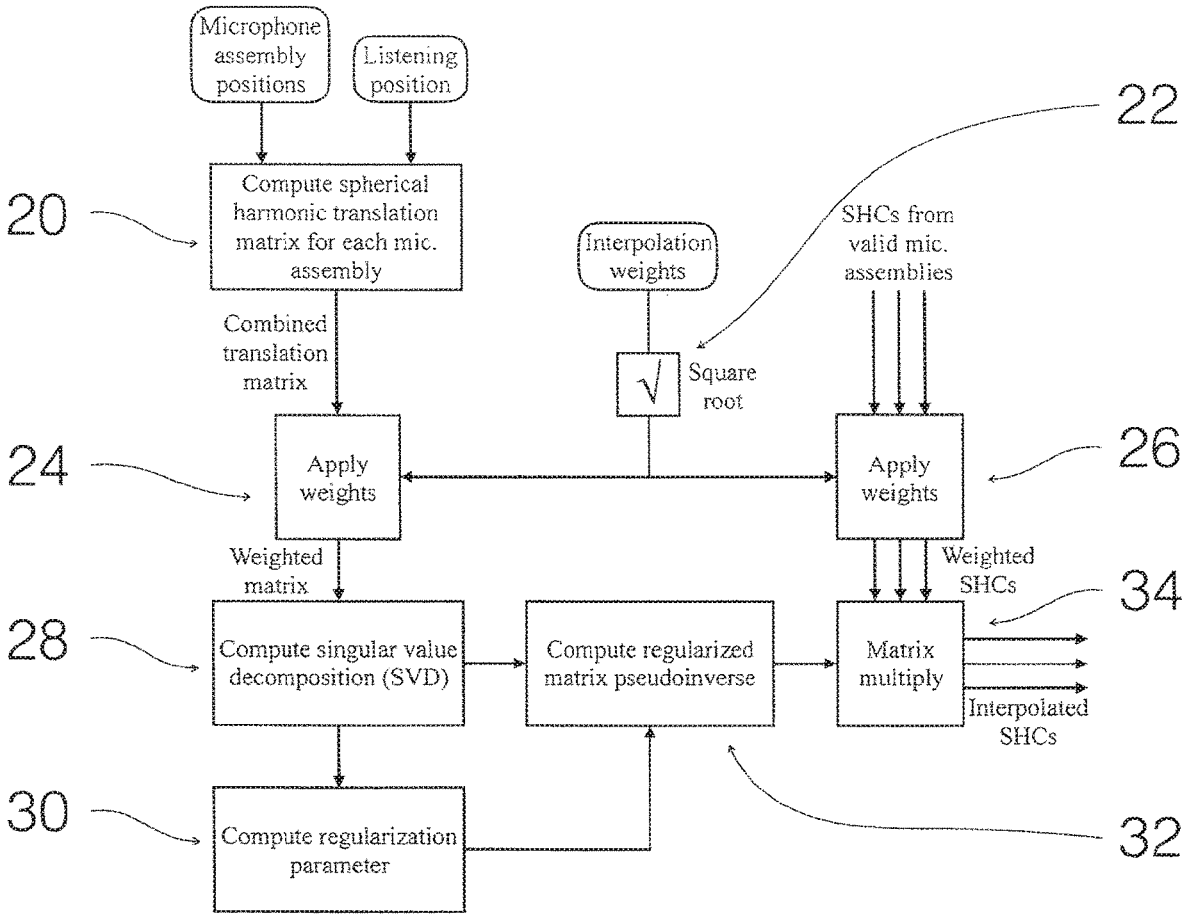
FIG. 3 is a flowchart of one potential implementation of the interpolation block 18 of FIG. 1.

One potential implementation of the interpolation step 18 is depicted in FIG. 3. Generally, this implementation of interpolation is performed in the frequency domain, with the sequence of steps carried out for each frequency. In step 20, spherical harmonic translation coefficients are computed for each microphone assembly using the distance to, and direction of, the listening position. The calculation of said spherical harmonic translation coefficients is described by Nail A. Gumerov and Ramani Duraiswami in the textbook "Fast Multipole Methods for the Helmholtz Equation in Three Dimensions," published by Elsevier Science, 2005. These coefficients are arranged in a combined translation matrix, with each microphone assembly's respective translation coefficients first arranged as a sub-matrix. Each sub-matrix, when multiplied by a column-vector of SHCs on the right, describes translation from the listening position to the respective microphone assembly. These sub-matrices are then arranged vertically by microphone assembly in the combined translation matrix.

In step 22, the square root of each interpolation weight is computed. Then, in step 24, each individual sub-matrix in the combined translation matrix is multiplied by the square root of the interpolation weight for the respective microphone assembly. In parallel, in step 26, the set of SHCs from each of the valid microphone assemblies is also multiplied by the square root of the interpolation weight for the respective microphone assembly. The weighted SHCs are then arranged into a combined column-vector, with each microphone assembly's respective SHCs first arranged as a column-vector, and then arranged vertically by microphone assembly in the combined column-vector.

In step 28, singular value decomposition (SVD) is performed on the weighted combined translation matrix, from which a regularization parameter is computed in step 30. The computed regularization parameter may be frequency-dependent so as to mitigate spectral coloration. One such method for computing such a regularization parameter is described by Joseph G. Tylka and Edgar Y. Choueiri in the article "Soundfield Navigation using an Array of Higher-Order Ambisonics Microphones," presented at the Audio Engineering Society's International Conference on Audio for Virtual and Augmented Reality, 2016. Using the regularization parameter and the SVD matrices, a regularized pseudoinverse matrix is computed in step 32.

Finally, in step 34, the combined column-vector of weighted SHCs is multiplied by the previously computed regularized pseudoinverse matrix. The result is an estimate of the SHCs of the sound field at the listening position.

Figure 4:
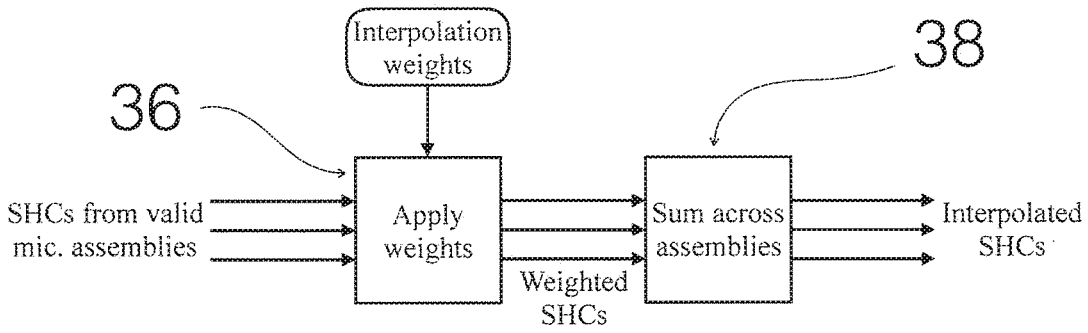
FIG. 4 is a flowchart of an alternative potential implementation of the interpolation block 18 of FIG. 1.

An alternate implementation of the interpolation step 18 is depicted in FIG. 4. Generally, this implementation of interpolation is the simplest possible implementation, as it involves performing a weighted averaging of the measured SHCs in the time domain. In step 36, the sets of SHCs from the valid microphone assemblies are multiplied by the interpolation weights for each respective microphone assembly. This weighted averaging step is conceptually equivalent to the method described by Alex Southern, Jeremy Wells. and Damian Murphy in the article "Rendering walk-through auralisations using wave-based acoustical models," presented at the $17^{th}$ European Signal Processing Conference (EUSIPCO), 2009.

In step 38, the sets of weighted SHCs summed term-by-term across different microphone assemblies. That is, the $n^{th}$ term of the interpolated SHCs is calculated by summing together the $n^{th}$ term from each set of weighted SHCs. For this implementation in particular, it is important that the interpolation weights be normalized (for example, such that the sum of the weights is equal to 1). The result is an estimate of the SHCs of the sound field at the listening position.

Figure 5:
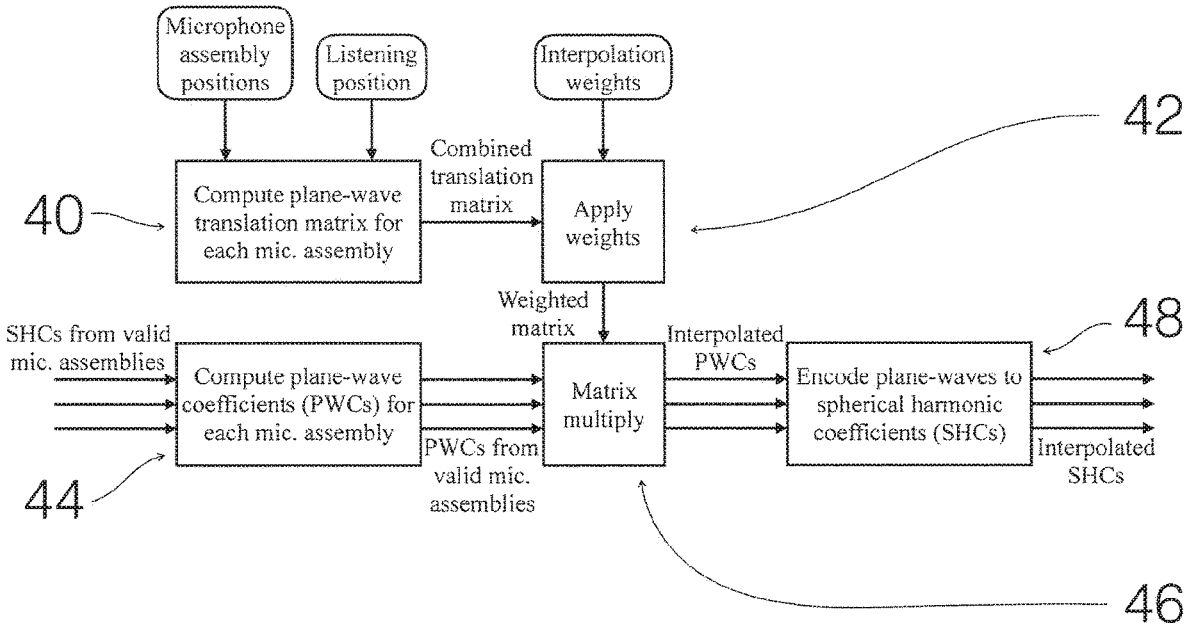
FIG. 5 is a flowchart of another alternative potential implementation of the interpolation block 18 of FIG. 1.

Another alternate implementation of the interpolation step 18 is depicted in FIG. 5. Generally, this implementation of interpolation is performed in the frequency domain, with the sequence of steps carried out for each frequency. In step 40, plane-wave translation coefficients are computed for each microphone assembly using the distance to, and direction of, the listening position. The calculation of said plane-wave translation coefficients is described by Frank Schultz and Sascha Spors in the article "Data-based Binaural Synthesis Including Rotational and Translatory Head-Movements," presented at the $52^{nd}$ International Conference of the Audio Engineering Society, September, 2013. These coefficients are arranged in a combined translation matrix, with each microphone assembly's respective translation coefficients first arranged as a sub-matrix. Each sub-matrix, when multiplied by a column-vector of PWCs on the right, describes translation from the respective microphone assembly to the listening position. These sub-matrices are then arranged horizontally by microphone assembly in the combined translation matrix.

In step 42, each individual sub-matrix in the combined matrix is multiplied by the interpolation weight for the respective microphone assembly. In parallel in step 44, the sets of SHCs from the valid microphone assemblies are converted to plane-wave coefficients (PWCs). The relationship between SHCs and PWCs is obtained from the Gegenbauer expansion, and is given by Dmitry N. Zotkin, Ramani Duraiswami, and Nail A. Gumerov in the article "Plane-Wave Decomposition of Acoustical Scenes Via Spherical and Cylindrical Microphone Arrays," published January, 2010, in volume 18, issue 1 of the IEEE Transactions on Audio, Speech, and Language Processing. These PWCs are then arranged into a combined column-vector, with each microphone assembly's respective PWCs first arranged as a column-vector, and then arranged vertically by microphone assembly in the combined column-vector.

In step 46, the combined column-vector of PWCs is multiplied by the previously computed weighted combined translation matrix. The result is an estimate of the PWCs of the sound field at the listening position. Finally, in step 48, the estimated PWCs are converted to SHCs, again using the relationship obtained from the Gegenbauer expansion mentioned previously.

Figure 6:
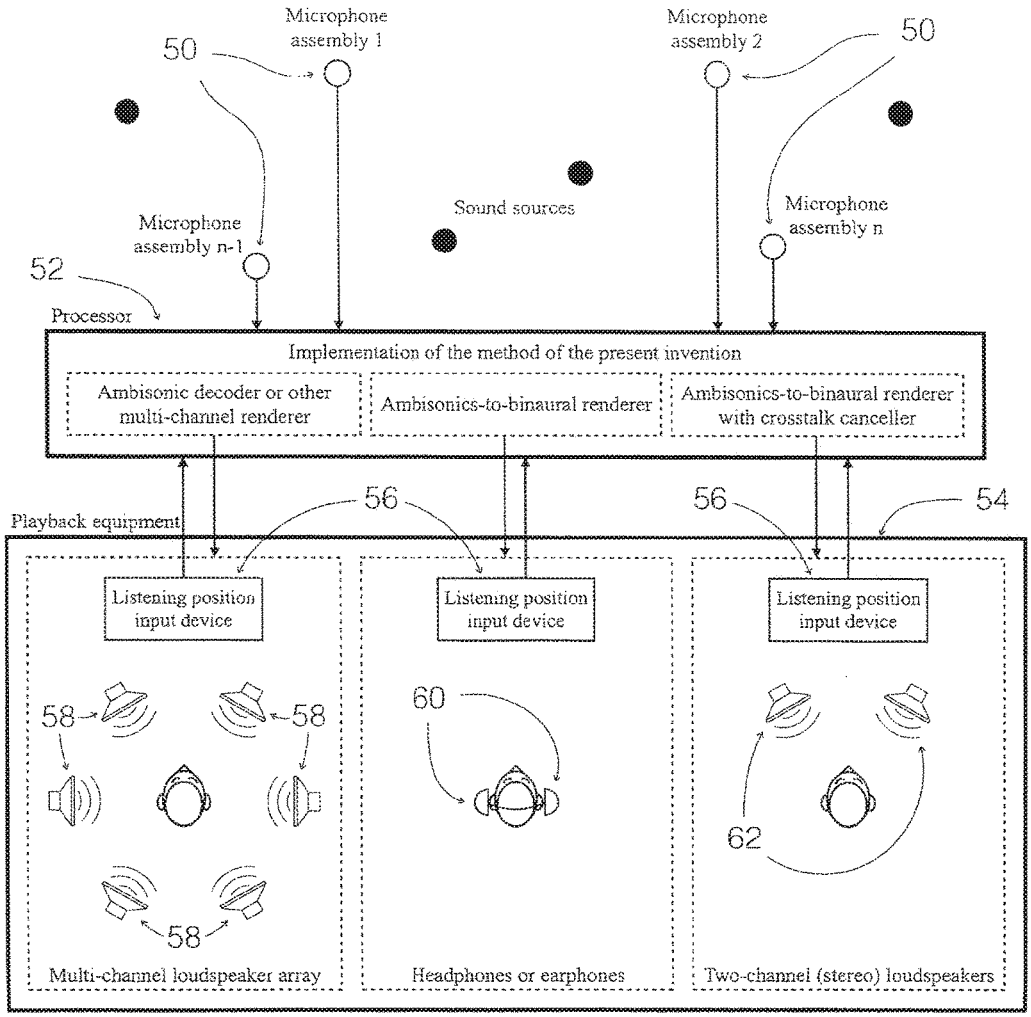
FIG. 6 is a diagram depicting a system that implements the general method for virtual navigation of a sound field through interpolation of the signals from an array of microphone assemblies of the present invention.

The method of the present invention can be embodied into a system, such as that shown in FIG. 6, which includes of at least two (2) spatially-distinct microphone assemblies 50, a processor 52 that receives signals from said microphone assemblies 50 and processes such signals using an implementation of the method of the present invention described above, and sound playback equipment 54 that receives and renders the processed signals from said processor.

Prior to performing the method of the present invention, the processor 52 first computes the spherical harmonic coefficients (SHCs) of the sound field using the raw capsule signals from the microphone assemblies 50. Procedures for obtaining SHCs from said capsule signals are well established in the prior art; for example, the procedure for obtaining SHCs from a closed rigid spherical microphone assembly is described by Jens Meyer and Gary Elko in the article "A highly scalable spherical microphone array based on an orthonormal decomposition of the soundfield," presented at IEEE International Conference on Acoustics, Speech, and Signal Processing (ICASSP), 2002. A more general procedure for obtaining SHCs from any compact microphone assembly is described by Angelo Farina. Simone Campanini, Lorenzo Chiesi. Alberto Amendola, and Lorenzo Ebri in the article "Spatial Sound Recording with Dense Microphone Arrays," presented at the $55^{th}$ International Conference of the Audio Engineering Society, August, 2014.

Once the measured SHCs are obtained, the processor 52 determines which of the measured SHCs are valid for use at a desired listening position based on near-field source location and positions of the microphone assemblies 50, computes a set of interpolation weights based on positions of said microphone assemblies 50 and said listening position, and interpolates said valid measured SHCs to obtain a set of SHCs for a desired intermediate listening position. During processing, the processor 52 also receives the desired listening position via an input device 56, e.g., a keyboard, mouse, joystick, or a real-time head/body tracking system. Subsequently, the processor 52 renders the interpolated SHCs for playback over the desired sound playback equipment 54.

The sound playback equipment 54 may comprise one of the following: a multi-channel array of loudspeakers 58, a pair of headphones or earphones 60, or a stereo pair of loudspeakers 62. For playback over a multi-channel array of loudspeakers, an ambisonic decoder (such as those described by Aaron J. Heller, Eric M. Benjamin, and Richard Lee in the article "A Toolkit for the Design of Ambisonic Decoders," presented at the Linux Audio Conference. 2012, and freely available as a MATLAB toolbox) or any other multi-channel renderer is required. For playback over headphones/earphones or stereo loudspeakers, an ambisonics-to-binaural renderer is required, such as that described by Svein Berge and Natasha Barrett in the article "A New Method for B-Format to Binaural Transcoding," presented at the $40^{th}$ International Conference of the Audio Engineering Society, 2010, and widely available as an audio plugin. Additionally, for playback of the binaural rendering over two loudspeakers, a crosstalk canceller is required, such as that described by Bosun Xie in chapter 9 of the textbook "Head-Related Transfer Function and Virtual Auditory Display," published by J. Ross Publishing, 2013.

While the foregoing invention has been described with reference to its preferred embodiments, various alterations and modifications will occur to those skilled in the art. All such variations and modifications are intended to fall within the scope of the appended claims. For example, the above description exclusively to recorded sound fields, but the system and method of the present invention may be applied to synthetic sound fields in the same manner to interpolate between discrete positions at which SHCs have been computed numerically.

What is claimed is:

1. A method for navigating a recorded sound field comprising the steps of:

measuring spherical harmonic coefficients (SHCs) of a sound field with two or more spatially-distinct higher-order Ambisonics (HOA) microphone assemblies;

detecting and locating sound sources near to said two or more microphone assemblies (i.e. near-field sources) through localization using two or more microphone assemblies;

receiving the desired listening position via an input device;

determining which of said SHCs are valid for use at said desired listening position based on near-field source location and positions of said microphone assemblies;

computing a set of interpolation weights for spatial interpolation based on positions of said microphone assemblies and said listening position;

interpolating said valid measured SHCs to obtain a set of SHCs for a desired intermediate listening position;

and rendering said interpolated SHCs for playback.

2. The method for navigating a recorded sound field of claim 1 wherein said step of interpolating said valid measured SHCs comprises:

computing spherical harmonic translation coefficients (SHTCs) for each microphone assembly based on a distance to said desired listening position and a direction of said desired listening position;

arranging said SHTCs in a combined translation matrix with said SHTCs for each of said microphone assemblies being arranged in a sub-matrix;

applying weights to said combined translation matrix by multiplying each sub-matrix by a square root of an interpolation weight;

computing weighted SHCs by multiplying said valid measured SHCs by a square root of said interpolation weight for a respective microphone assembly and arranging such weighted SHCs by microphone assembly;

computing singular value decomposition (SVD) matrices from said combined translation matrix;

determining a regularization parameter and using such regularization parameter and said SVD martices to create a regularized pseudoinverse matrix; and estimating the SHCs of the recorded sound field from said weighted SHCs and said regularized pseudoinverse matrix.

3. The method for navigating a recorded sound field of claim 1 wherein said step of interpolating said valid measured SHCs comprises:

computing weighted SHCs by multiplying said valid measured SHCs by an interpolation weight for a respective microphone assembly; and estimating the SHCs of the recorded sound field from said weighted SHCs by summing said weighted SHCs term-by-term across different microphone assemblies.

4. The method for navigating a recorded sound field of claim 1 wherein said step of interpolating said valid measured SHCs comprises:

computing plane-wave translation coefficients (PWTCs) for each of said microphone assemblies based on a distance to said desired listening position and a direction of said desired listening position;

arranging said PWTCs in a combined translation matrix with said PWTCs for each of said microphone assemblies being arranged in a sub-matrix;

applying weights to said combined translation matrix by multiplying each of said sub-matrices by an interpolation weight;

converting said valid measured SHCs to plane-wave coefficients (PWCs);

estimating PWCs of said sound field at said desired listening position by multiplying said converted PWCs by said weighted combined translation matrix; and converting said estimated PWCs to SHCs.

5. A system for navigating a recorded sound field comprising:

at least two spatially-distinct higher-order Ambisonics (HOA) microphone assemblies;

at least one sound source;

sound playback equipment;

and a processor that receives signals from said at least two microphone assemblies and generates signals for said playback equipment by:

measuring spherical harmonic coefficients (SHCs) of a sound field with two or more spatially-distinct higher-order Ambisonics (HOA) microphone assemblies;

detecting and locating sound sources near to said at least two microphone assemblies (i.e. near-field sources) through localization using at least two microphone assemblies;

receiving the desired listening position via an input device;

determining which of said SHCs are valid for use at said desired listening position based on near-field source location and positions of said microphone assemblies;

computing a set of interpolation weights for spatial interpolation based on positions of said microphone assemblies and said listening position;

interpolating said valid measured SHCs to obtain a set of SHCs for a desired intermediate listening position;

and rendering said interpolated SHCs for playback over said sound playback equipment.

6. The system for navigating a recorded sound field of claim 5 wherein said sound playback equipment comprises headphones.

7. The system for navigating a recorded sound field of claim 5 wherein said sound playback equipment comprises two-channel stereo loudspeakers.

8. The system for navigating a recorded sound field of claim 5 wherein said sound playback equipment comprises a multi-channel loudspeaker array.

9. The system for navigating a recorded sound field of claim 5 wherein said sound playback equipment comprises earphones.

10. The system for navigating a recorded sound field of claim 5 wherein said processor interpolates said valid measured SHCs by:

computing spherical harmonic translation coefficients (SHTCs) for each microphone assembly based on a distance to said desired listening position and a direction of said desired listening position;

arranging said SHTCs in a combined translation matrix with said SHTCs for each of said microphone assemblies being arranged in a sub-matrix;

applying weights to said combined translation matrix by multiplying each sub-matrix by a square root of an interpolation weight;

computing weighted SHCs by multiplying said valid measured SHCs by a square root of said interpolation weight for a respective microphone assembly and arranging such weighted SHCs by microphone assembly;

computing singular value decomposition (SVD) matrices from said combined translation matrix;

determining a regularization parameter and using such regularization parameter and said SVD martices to create a regularized pseudoinverse matrix; and estimating the SHCs of the recorded sound field from said weighted SHCs and said regularized pseudoinverse matrix.

11. The system for navigating a recorded sound field of claim 5 wherein said processor interpolates said valid measured SHCs by:

computing weighted SHCs by multiplying said valid measured SHCs by an interpolation weight for a respective microphone assembly; and estimating the SHCs of the recorded sound field from said weighted SHCs by summing said weighted SHCs term-by-term across different microphone assemblies.

12. The system for navigating a recorded sound field of claim 5 wherein said processor interpolates said valid measured SHCs by:

computing plane-wave translation coefficients (PWTCs) for each of said microphone assemblies based on a distance to said desired listening position and a direction of said desired listening position;

arranging said PWTCs in a combined translation matrix with said PWTCs for each of said microphone assemblies being arranged in a sub-matrix;

applying weights to said combined translation matrix by multiplying each of said sub-matrices by an interpolation weight;

converting said valid measured SHCs to plane-wave coefficients (PWCs);

estimating PWCs of said sound field at said desired listening position by multiplying said converted PWCs by said weighted combined translation matrix; and converting said estimated PWCs to SHCs.

* * * * *